United States Patent [19]

Schaff et al.

[11] Patent Number: 5,036,769

[45] Date of Patent: Aug. 6, 1991

[54] PYROFUZE PIN FOR ORDNANCE ACTIVATION

[75] Inventors: James M. Schaff; Amos J. Diede, both of Ridgecrest, Calif.

[73] Assignee: The United States of America as represented by the Secretary of the Navy, Washington, D.C.

[21] Appl. No.: 490,910

[22] Filed: Mar. 9, 1990

[51] Int. Cl.[5] ..... F42C 15/00; F42C 19/00

[52] U.S. Cl. ..... 102/221; 89/1.55; 102/293; 102/335

[58] Field of Search ..... 89/1.55; 102/200, 221, 102/293, 335

[56] References Cited

U.S. PATENT DOCUMENTS

| | | | |
|---|---|---|---|
| 3,762,267 | 10/1973 | Travor et al. | 102/275.11 |
| 3,976,008 | 8/1976 | Altschuler et al. | 102/335 |
| 4,073,681 | 2/1978 | Glazar et al. | 376/338 |
| 4,299,166 | 11/1981 | Carignan et al. | 89/1.55 |
| 4,405,104 | 9/1983 | Charman et al. | 89/1.14 |
| 4,889,324 | 12/1989 | Brosnan et al. | 266/157 |

*Primary Examiner*—David H. Brown

*Attorney, Agent, or Firm*—Sol Sheinbein; Melvin J. Sliwka; Harvey A. Gilbert

[57] ABSTRACT

An electrically controllable "Pyrofuze" pin device for ordnance device activation which functionally replaces the mechanical barrier and arming wire or other rigid and removable means used to provide ordnance device activation. The device includes a "Pyrofuze" pin, a connecting ignitor transfer charge, and ignitor, and electrical terminals to provide power from an external power supply, and a weatherproof housing. When electrically activated the "Pyrofuze" pin is reduced to molten by-products which functionally eliminate the mechanical barrier and permits the activation of the ordnance device.

12 Claims, 1 Drawing Sheet

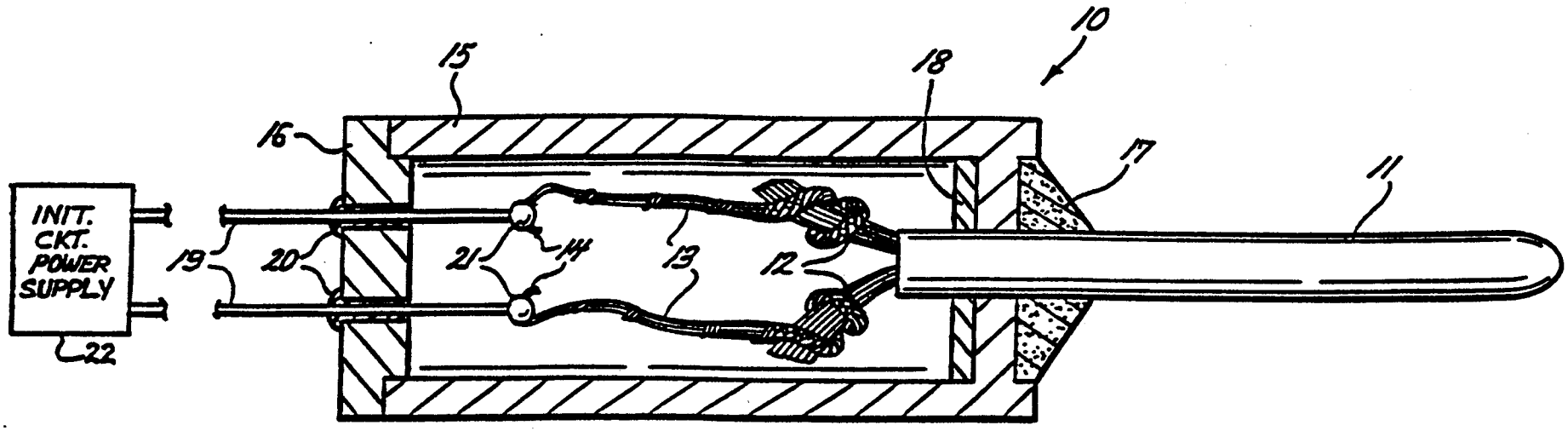
10
11
12
13
14
15
16
17
18
19
20
21
22
INIT. CKT. POWER SUPPLY

PYROFUZE PIN FOR ORDNANCE ACTIVATION

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The present invention relates in general to ordnance activation devices and more particularly to pin-restrained mechanisms for aircraft ordnance arming devices.

BACKGROUND OF THE INVENTION

It is conventional practice that brass or steel arming wires have provided a mechanical barrier to prevent arming or premature operation of ordnance devices. Generally, arming wires are attached to a fixed point on an aircraft such that upon release of the ordnance, arming wires are extracted from the ordnance, thereby beginning the arming sequence. Several disadvantages are associated with the use of arming wires for ordnance delivered by aircraft.

Installation procedure is complex and must be performed exactly to insure that arming wires are tied off and attached to the ejection rack in the proper locations in order to arm the ordnance as intended. The installation of one to five arming wires for each weapon is labor intensive and conducive to errors.

Through the use of a selectable arming solenoid, the pilot can control whether the arming wire is retained in the solenoid thus arming the ordnance or, released, and thus preventing the arming of the ordnance. These solenoids have a history of unreliable operation which may result in the weapon not functioning as desired.

Defective arming wires may cause improper arming by breaking prior to extraction from the ordnance device and may cause aircraft damage by remaining attached to the ejection rack after weapon release. Whipping of the broken arming wire by the airstream against the aircraft, may result in damage to composite materials or paint removal thus necessitating additional maintenance actions. Fahnestock or safety clips, installed to prevent the pulling of certain arming wires by the airstream become airborne debris once the arming wire is pulled. This debris may damage the aircraft.

SUMMARY OF THE INVENTION

The present invention is an electrically controllable "Pyrofuze" pin device for controlling ordnance activation. A principal object of the present invention is to provide a mechanical barrier preventing inadvertent ordnance device activation which will allow ordnance device activation when desired without requiring manual or mechanical removal of a restraining pin. Such a device permits complete electrical control of an arming system. The invention provides for this new and novel feature by using an electrically initiated "Pyrofuze" pin in lieu of a conventional ordnance activation restraining pin. In one embodiment of the present invention, an electrical current heats the "Pyrofuze" pin to initiate a self-sustaining, continuously propagating and uninterrupted alloying reaction. As the pin alloys, small non-obstructing beads of molten "Pyrofuze" by-products are formed which can no longer serve as a mechanical barrier. In this embodiment of the invention, problems associated with arming wires, complicated installation procedures, unreliable arming wire solenoids, defective arming wires, aircraft damage and airborne debris are eliminated. An additional benefit of the present invention is that arming mechanism can be activated without mechanically removing the restraining "Pyrofuze" pin thereby allowing for a completely electrically operated arming system.

BRIEF DESCRIPTION OF THE DRAWINGS

The numerous features and advantages of the present invention will be readily understood from the following detailed description when read in view of the appended drawing wherein:

FIG. 1 is a cross sectional, side-view of the "Pyrofuze" device.

DETAILED DESCRIPTION OF THE INVENTION

Referring now to FIG. 1 the "Pyrofuze" pin device, depicted generally by the numeral 10, is shown in cross section. The "Pyrofuze" pin 11, fashioned from "Pyrofuze" or other similarly reacting or electrothermally removable material, provides a physical barrier to and mechanically prevents the activation of an ordnance arming device and thus functionally replaces conventional restraining pins. The "Pyrofuze" pin 11 is fashioned by pressing individual strands of "Pyrofuze" wires into a solid pin shape. A plurality of the wires extend in two legs beyond the pressed portion constituting the pin 11 to form the ignitor transfer charge 12, the ignitor branch 13, and the terminal solder hook 14 in each of said legs. Two 8 mil, 8 strand "Pyrofuze" wire bundles are separated from the plurality of wires to form the ignitor transfer charge 12. Two 5 mil 8 strand bundles are also separated and wrapped around the ignitor charge 12. Each of the strand bundles constituting the ignitor branches 13 is securely wrapped one and a half times around one of the wire bundles constituting the ignitor transfer charge 12. Four of the 5 mil 8 strands are then cut off. The remaining four strands continue on to become one of the two (2) four-strand ignitor branches 13 and terminal solder hooks 14 on each side. The number of wrap turns may be varied as necessary to insure ignition for the configuration selected for a particular application. The strands within the remaining portions of each bundle of the ignitor bundles are trimmed to increasing lengths and twisted together. The longest strand of each ignitor bundle is shaped in the form of an open hook on the end making an open terminal solder hook 14.

The "Pyrofuze" pin 11 is mounted in a weather-proof housing 15 to form the "Pyrofuze" pin device 10. The housing 15 functions as the mounting structure for securing the invention to an ordnance device and provides for protecting and supporting the ignitor branches 13 and ignitor transfer charge 12 located therein. The "Pyrofuze" pin 11 is mounted through an adhesive blocking disk 18 into the housing 15 with adhesive filler 17. The adhesive blocking disk 18 fits snugly around the end of the "Pyrofuze" pin 11 extending into the housing 15 to prevent the adhesive filler 17 surrounding the pin 11 as it exits the housing 15 from seeping into the ignitor transfer charge 12 disposed within the housing 15. The terminal supporter 16 which supports the electrical terminals 19 is mounted in the opposite end of the housing 15 from that through which the pin 11 exits. The electrical terminals 19 pass through the electrical insulators 20 and through the terminal supporter 16 and are held in place by adhesive filler 17. A solder loop 21 is formed on the end of each of the electrical terminals 19 inside the housing 15 by bending that end in a circular pattern until it touches or almost touches the standing part of the electrical wire from which it extends. One terminal solder hook 14 is passed through each solder loop 21 and soldered into place. The terminal supporter 16 also serves to seal the ignitor branches 13 and the ignitor transfer charge 12 within the housing 15 from the external environment thus completing the weather proof envelope.

The "Pyrofuze" pin device 10 is connected to an externally located initiation circuitry power supply 22 by the electrical terminals 19. This circuitry initiates the "Pyrofuze" pin device 10 by supplying six (6) amperes of electrical current to the electrical terminals 19. As the current flows through one ignitor branch 13, across the ignitor transfer charge 12 and back through the other ignitor branch 13, the single wire of the four-strand "Pyrofuze" wire bundle of each branch heats. The alloying reaction begins when either wire reaches the alloying initiation temperature. When the alloying reaction begins the "Pyrofuze" wire melts and the electrical path is broken thus halting the current flow. Once initiated the alloying reaction zone continues and progressively, continuously, and uniterruptedly travels along the ignitor branch 13 where additional "Pyrofuze" wire is encountered. Enough excess energy exists within the reaction zone of the ignitor branches 13 to continue to initiate and propagate the alloying reaction in the "Pyrofuze" wires as they are traversed from the direction of the electrical terminals 19 through the ignitor branches 13 towards the ignitor transfer charge 12. When the self-propagating reaction zone encounters the ignitor transfer charge 12, the additional "Pyrofuze" material of the ignitor transfer charge 12 is added to the reaction. The reaction then progresses to "Pyrofuze" pin 11. As the "Pyrofuze" pin 11 alloys it is reduced to molten "Pyrofuze" by-products. In the preferred embodiment, the initiation and alloying process occurs in approximately 200 milliseconds. By appropriate selection of "Pyrofuze" wire, diameter, length, and strand arrangements, alloy process time can be varied to satisfy particular application requirements.

The "Pyrofuze" pin 11 of the preferred embodiment was fabricated from "Pyrofuze" material in the form of braid. The braid is woven by the manufacturer from "Pyrofuze" wire. The wire of the preferred embodiment is a high resistance composition having a resistance of 62 ohms per cmf and a nominal tensile strength of 90,000 psi. The wire consists of an inner core of #5056 Aluminum surrounded by an outer jacket of 95% Palladium and 5% Ruthenium. The particular braid used in the preferred embodiment was obtained from Pyrofuze Corp. of Mount Vernon, N.Y.

The "Pyrofuze" pin 11 was formed by cutting braid precleaned with acetone into the desired lengths. The cleaned braid was then introduced into an acetone cleaned die configured to provide the desired "Pyrofuze" pin shape when the braid is compressed therein. Three (3) 1.2 inch pieces of the 8 mil, 8 strand braid are next placed in the die cavity. The ends are carefully lined up and then pushed down with the longer of two blades used to compress the braid into the die. The 1.5 inch, 8 mil braid and the 2.5 inch, 5 mil braid, and three additional 1.2 inch, 8 mil braid are placed in the die cavity and lined up with the earlier inserted braid material. All of the braid material in the die is next compressed into the die cavity with a force of between 500 and 1000 pounds. Next, the second 2.5 inch, 5 mil braid, the 1.5 inch, 8 mil braid and the last three 1.2 inch, 8 mil braid are introduced to the die and lined up with the braid material already in the die. A second and shorter compression blade, which is designed to stop at the top of the die cavity is positioned and then moved into the die to compress the most recently added braid material into the pin structure. The die is next heated to 550° F. or within the range of 550° F. to 575° F. and braid the material therein subjected to a four (4) ton compression force in a hydraulic press for thirty (30) seconds. The die is next opened and the pin is removed and finished by filing to a smooth surface finish.

It should be noted that the pin 11 thus formed is capable of sustaining the electrothermally initiated alloying reaction even in applications where it extends through and is in surface or peripheral contact with a surrounding thermally conductive and heat-sink-like surface.

The novel features of the "Pyrofuze" pin device 10 include the ability to use electrical control and operation to remove the physical barrier to ordnance arming and also to allow the sequence to continue after removal of electrical power. The "Pyrofuze" pin 11 of the "Pyrofuze" device 10 is inserted into the ordnance device activation mechanism just as a mechanical pin would be. To activate the ordnance device, the initiation circuitry power supply 22 applies power to the electrical terminals 19 which initiates the alloying reaction at the ignitor branch 13 and reduces the "Pyrofuze" pin 11 to molten by-products. Once the alloying reaction has begun, it is unnecessary to continue applying electrical power. The reaction will continue until all "Pyrofuze" material has been reduced to molten by-products. The molten by-products are not capable of restraining the ordnance device activation mechanism. The elimination of the "Pyrofuze" pin 11 by the alloying reaction begun by the energy supplied by the power from the ordnance device initiation circuitry has the same effect as removal or extraction of the arming wire from the ordnance device. The arming device in either such case is activated.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

We claim:

1. A "Pyrofuze" pin device for ordnance activation comprising:

a housing for protecting and supporting the various elements of said "Pyrofuze" pin device;

a "Pyrofuze" pin for preventing ordnance activation, said pin having a first of two opposite ends operationally disposed through one end of said housing and a second of said opposite ends disposed within said housing;

an ignitor transfer charge for transferring an alloying reaction zone to said "Pyrofuze" pin, said charge disposed in said housing and having a first of two opposite ends attached to said second of said opposite ends of said "Pyrofuze" pin;

an ignitor branch for tailoring the device initiation time, said branch disposed in said housing and having one end attached to the second of the two opposite ends of said ignitor transfer charge; and electrical terminals for connecting said "Pyrofuze" device to externally located initiation circuitry, said terminals disposed through and into the end of said housing opposite said one end through which said "Pyrofuze" pin is disposed, and attached to the other end of said ignitor branch therein.

2. A "Pyrofuze" pin device as in claim 1 wherein said "Pyrofuze" pin comprises a plurality of "Pyrofuze" strands pressed and molded into a solid pin shape on said first end and with two legs of bundled "Pyrofuze" strands extending from said second and opposite end.

3. A "Pyrofuze" pin device as in claim 2 wherein said ignitor transfer charge comprises a plurality of "Pyrofuze" strands extending in two legs from said second and opposite end of said pin.

4. The "Pyrofuze" pin device as in claim 1 wherein said ignitor branch comprises a plurality of "Pyrofuze" strands extending between and affixed to the facing ends of said ignitor transfer charge and said electrical terminals.

5. The "Pyrofuze" pin device as in claim 4 wherein said ignitor branch is affixed to said ignitor transfer charge by being securely wrapped around the bundle of "Pyrofuze" strands comprising said ignitor transfer charge.

6. The "Pyrofuze" pin device as in claim 5 wherein said ignitor branch is securely wrapped at least one and one-half times around said bundle of "Pyrofuze" strands comprising said ignitor transfer charge.

7. A "Pyrofuze" pin device for ordnance activation comprising:

means for mounting, protecting, and supporting various elements of the "pyrofuze" pin device from the environment;

a removable means for mechanically preventing ordnance activation, said means being operationally disposed within and extending out from said means for mounting, protecting, and supporting; and means for initiating and effecting the removal of said means for mechanically preventing ordnance activation, said means extending from without, through, and into said means for mounting protecting, and supporting, and in operative association with said means therein for mechanically preventing ordnance activation.

8. A "Pyrofuze" pin device as in claim 7 wherein said means for mounting, protecting, and supporting comprises a weather-proof housing.

9. The "Pyrofuze" pin device of claim 7 wherein said means for mechanically preventing ordnance activation is a removable barrier of compressed "Pyrofuze" material.

10. The "Pyrofuze" pin device of claim 7 wherein said means for mechanically preventing ordnance activation is a self-eliminating barrier of compressed stranded "Pyrofuze" material.

11. The "Pyrofuze" pin device of claim 9 wherein said barrier is compressed braided "Pyrofuze" material.

12. The "Pyrofuze" pin device for ordnance activation of claim 11 wherein said barrier is energized by an electrical power supply.

* * * * *